US007275599B2

(12) United States Patent
Wilde

(10) Patent No.: US 7,275,599 B2
(45) Date of Patent: Oct. 2, 2007

(54) POSITIVE PRESSURE GAS JACKET FOR A NATURAL GAS PIPELINE

(75) Inventor: Glenn Wilde, Calgary (CA)

(73) Assignee: Optimum Production Technologies Inc., Calgary (CA)

( * ) Notice: Subject to any disclaimer, the term of this patent is extended or adjusted under 35 U.S.C. 154(b) by 114 days.

(21) Appl. No.: 10/568,588

(22) PCT Filed: Aug. 27, 2004

(86) PCT No.: PCT/CA2004/001567

§ 371 (c)(1),
(2), (4) Date: Feb. 17, 2006

(87) PCT Pub. No.: WO2005/024289

PCT Pub. Date: Mar. 17, 2005

(65) Prior Publication Data

US 2006/0237195 A1 Oct. 26, 2006

(30) Foreign Application Priority Data

Sep. 4, 2003 (CA) ..... 2439487

(51) Int. Cl.
*E21B 43/12* (2006.01)

(52) U.S. Cl. ..... 166/372; 166/53

(58) Field of Classification Search ..... None
See application file for complete search history.

(56) References Cited

U.S. PATENT DOCUMENTS 3,707,157 A * 12/1972 Tipton et al. ..... 137/14
5,400,858 A * 3/1995 Blanchard et al. ..... 166/370
5,547,021 A * 8/1996 Raden ..... 166/250.07

* cited by examiner

*Primary Examiner*—Frank Tsay
(74) *Attorney, Agent, or Firm*—Donald V. Tomkins

(57) ABSTRACT

The present invention provides a method and apparatus whereby the intake pipeline running between the production chamber of a natural gas well and the suction inlet of an associated wellhead compressor is completely enclosed, in airtight fashion, within a jacket of natural gas under positive pressure (i.e., higher than atmospheric). Being enclosed inside this "positive pressure jacket", the intake pipeline is not exposed to the atmosphere at any point. This allows gas to be drawn into the compressor through the intake pipeline under a negative pressure, without risk of air entering the intake pipeline should a leak occur in the pipeline. If such a leak occurs, there will merely be a harmless transfer of gas from the positive pressure jacket into the intake pipeline. If a leak occurs in the positive pressure jacket, gas therefrom will escape into the atmosphere, and entry of air into the positive pressure jacket will be impossible.

30 Claims, 6 Drawing Sheets

POSITIVE PRESSURE GAS JACKET FOR A NATURAL GAS PIPELINE

FIELD OF THE INVENTION

The present invention relates to methods and apparatus for protecting against the influx of air into a pipeline carrying a combustible gas under negative pressure, and particularly to such methods and apparatus for use in association with a pipeline carrying natural gas under negative pressure from a natural gas well to a gas compressor.

BACKGROUND OF THE INVENTION

Natural gas is commonly found in subsurface geological formations such as deposits of granular material (e.g., sand or gravel) or porous rock. Production of natural gas from these types of formations typically involves drilling a well a desired depth into the formation, installing a casing in the wellbore (to keep the well bore from sloughing and collapsing), perforating the casing in the production zone (i.e., the portion of the well that penetrates the gas-bearing formation) so that gas can flow into the casing, and installing a string of tubing inside the casing down to the production zone. Gas can then be made to flow up to the surface through a production chamber, which may be either the tubing or the annulus between the tubing and the casing. The gas flowing up the production chamber is conveyed through an intake pipeline running from the wellhead to the suction inlet of a wellhead compressor. The compressed gas discharged from the compressor is then conveyed through another pipeline to a gas processing facility and sales facility as appropriate.

When natural gas is flowing up a well, formation liquids will tend to be entrained in the gas stream, in the form of small droplets. As long as the gas is flowing upward at or above a critical velocity (the value of which depends on various well-specific factors), the droplets will be lifted along with the gas to the wellhead. In this situation, the gas velocity provides the means for lifting the liquids, and the well is said to be producing by "velocity-induced flow". Because liquids in the gas stream can cause internal damage to most gas compressors, a gas-liquid separator is provided in the intake pipeline to remove liquids from the gas stream before entering the compressor. The liquids may be pumped from the separator and reintroduced into the gas flow at a point downstream of the compressor, for eventual separation at the gas processing facility. Much more commonly, however, the liquids are collected in a tank on the well site.

In order to optimize total volumes and rates of gas recovery from a gas reservoir, the bottomhole flowing pressure should be kept as low as possible. The theoretically ideal case would be to have a negative bottomhole flowing pressure so as to facilitate 100% gas recovery from the reservoir, resulting in a final reservoir pressure of zero. In order to reduce the bottomhole pressure to a negative value, or to a very low positive value, it would be necessary to have a negative flowing pressure (i.e., less than atmospheric pressure) in the intake pipeline. This can be readily accomplished using well-known technology; i.e., by providing a wellhead compressor of sufficient power.

However, negative pressure in a natural gas pipeline would present an inherent problem, because any leak in the line (e.g., at pipeline joints) would allow the entry of air into the pipeline, because air would naturally flow to the area of lower pressure. This would create a risk of explosion should the air/gas mixture be exposed to a source of ignition. In addition to the explosion risk, entry of air into the pipeline also creates or increases the risk of corrosion inside the pipeline. For these reasons, the pressure in the intake pipeline is typically maintained at a positive level (i.e., higher than atmospheric). Therefore, in the event of a leak in the intake pipeline, gas in the pipeline will escape into the atmosphere, rather than air entering the pipeline. The explosion and corrosion risks are thus minimized or eliminated, but in a way that effectively limits ultimate recovery of gas reserves from the well.

One way of minimizing or eliminating the explosion and corrosion risks, while facilitating the use of negative pressures in the intake pipeline, would be to provide an oxygen sensor in association with the pipeline. The oxygen sensor would be adapted to detect the presence of oxygen inside the pipeline, and to shut down the compressor immediately upon detection of oxygen. This system thus would more safely facilitate the use of compressor suction to induce negative pressures in the intake pipeline and, therefore, to induce negative or low positive bottomhole flowing pressures. However, this system has an inherent drawback in that its effectiveness would rely on the proper functioning of the oxygen sensor. If the sensor malfunctions, and if the malfunction is not detected and remedied in timely fashion, the risk of explosion and/or corrosion will become manifest once again. This fact highlights an even more significant drawback in that this system would not prevent the influx of air into the pipeline in the first place, but is merely directed to mitigation in the event of that undesirable event.

For the foregoing reasons, there is a need for an improved method and apparatus for minimizing and protecting against the risk of explosion arising from the influx of air into a pipeline carrying a combustible gas such as natural gas under negative pressure. There is a particular need for such methods and apparatus that do not require or rely on the use of oxygen sensors or other instruments or devices that are prone to malfunction. Even more particularly, there is a need for such methods and apparatus that prevent the influx of air into the pipeline in the first place. The present invention is directed to these needs.

BRIEF DESCRIPTION OF THE INVENTION

In general terms, the present invention provides a method and apparatus whereby the intake pipeline running between the production chamber of a natural gas well and the suction inlet of an associated wellhead compressor is completely enclosed, in vapour-tight fashion, within a jacket of natural gas under positive pressure (i.e., higher than atmospheric). Being enclosed inside this "positive pressure jacket", the intake pipeline is not exposed to the atmosphere at any point. This allows gas to be drawn into the compressor through the intake pipeline under a negative pressure, without risk of air entering the intake pipeline should a leak occur in the pipeline. If such a leak occurs, there would merely be a harmless transfer of gas from the positive pressure jacket into the intake pipeline. If a leak occurs in the positive pressure jacket, gas therefrom would escape into the atmosphere, and entry of air into the positive pressure jacket would be impossible.

Accordingly, in one aspect the present invention is a positive pressure gas jacket apparatus for use in association with a natural gas well facility, said well facility comprising:

(a) a wellbore extending from ground surface into a subsurface gas production zone;

(b) a wellhead apparatus at the top of the wellbore;

(c) a tubing string extending from the wellhead into the wellbore, for conveying gas from the production zone, said tubing string and wellbore defining an annulus;

(d) an upstream pipeline in fluid communication with a production chamber selected from the tubing and the annulus, and connecting to the suction manifold of a gas compressor; and (e) a downstream pipeline extending from the discharge manifold of the compressor:

said apparatus comprising:

(f) a vapour-tight enclosure defining an internal chamber surrounding the upstream pipeline; and (g) a gas recirculation pipeline extending between a selected point on the downstream pipeline and a selected point on the vapour-tight enclosure, such that the gas recirculation pipeline is in fluid communication with both the downstream pipeline and the internal chamber of the vapour-tight enclosure;

characterized in that the upstream pipeline will be completely enveloped by pressurized natural gas introduced into the internal chamber from the downstream pipeline via the recirculation pipeline.

In a second aspect, the invention is a method of preventing air leaks into the upstream pipeline of a natural gas well facility as described above, the method comprising the steps of:

(f) providing a vapour-tight enclosure defining an internal chamber surrounding the upstream pipeline; and (g) providing a gas recirculation pipeline extending between a selected point on the downstream pipeline and a selected point on the vapour-tight enclosure, such that the gas recirculation pipeline is in fluid communication with both the downstream pipeline and the internal chamber of the vapour-tight enclosure;

said method being characterized in that the upstream pipeline will be completely enveloped by pressurized natural gas introduced into the internal chamber from the downstream pipeline via the recirculation pipeline.

In preferred embodiments of the apparatus and the method, a throttling valve is provided in the recirculation pipeline, for regulating the flow of gas from the downstream pipeline into the recirculation pipeline.

Also in preferred embodiments, a pressure regulator valve (PRV) is disposed between the internal chamber of the vapour-tight enclosure and a well injection chamber selected from the tubing and the annulus, said injection chamber not being the production chamber. The PRV is adapted to prevent gas pressure in the internal chamber from exceeding a selected pre-set value, by allowing gas from the internal chamber to enter the well injection chamber when the internal chamber pressure exceeds the pre-set value.

The vapour-tight enclosure is preferably of welded steel construction. However, other materials and known fabrication methods may be used without departing from the scope of the invention.

In the preferred embodiment, the positive pressure gas jacket apparatus also comprises a gas-liquid separator apparatus connected into the upstream pipeline for separating liquids out of raw gas from the well, with a liquid discharge line for removing separated liquids, and with the internal chamber of the vapour-tight enclosure surrounding the separator apparatus as well as the upstream pipeline. In accordance with this embodiment, pressurized gas introduced into the internal chamber from the downstream pipeline via the recirculation pipeline will completely envelope both the separator apparatus and the discharge line.

In a particularly preferred embodiment, the separator apparatus comprises a separator vessel, a blow case, and a liquid transfer line for carrying separated liquids from the separator vessel to the blow case. The blow case is of a type well known in the art, being a pressure vessel for retaining the separated liquids under positive pressure. The liquid discharge line connects to the blow case and extends therefrom through the vapour-tight enclosure for conveying liquids from the blow case under positive pressure to a liquid disposal point (which may be a storage tank, or alternatively may be a connection to the downstream pipeline). Since the liquids leave the blow case under positive pressure, it is not necessary for the vapour-tight enclosure to enclose any portion of the liquid discharge line.

In an alternative embodiment not having a blow case, liquids removed by the separator apparatus are discharged into the liquid discharge line under negative pressure, and the liquid discharge line connects to a vacuum pump, which in turn discharges the liquids under positive pressure into a liquid return line. The internal chamber of the vapour-tight enclosure surrounds the liquid discharge line as well as the separator apparatus and the upstream pipeline, such that pressurized gas introduced into the internal chamber from the downstream pipeline via the recirculation pipeline will completely envelope the upstream pipeline, the separator apparatus, and the discharge line.

BRIEF DESCRIPTION OF THE DRAWINGS

Embodiments of the invention will now be described with reference to the accompanying figures, in which numerical references denote like parts, and in which.

DETAILED DESCRIPTION OF THE PREFERRED EMBODIMENT

Figure 1:
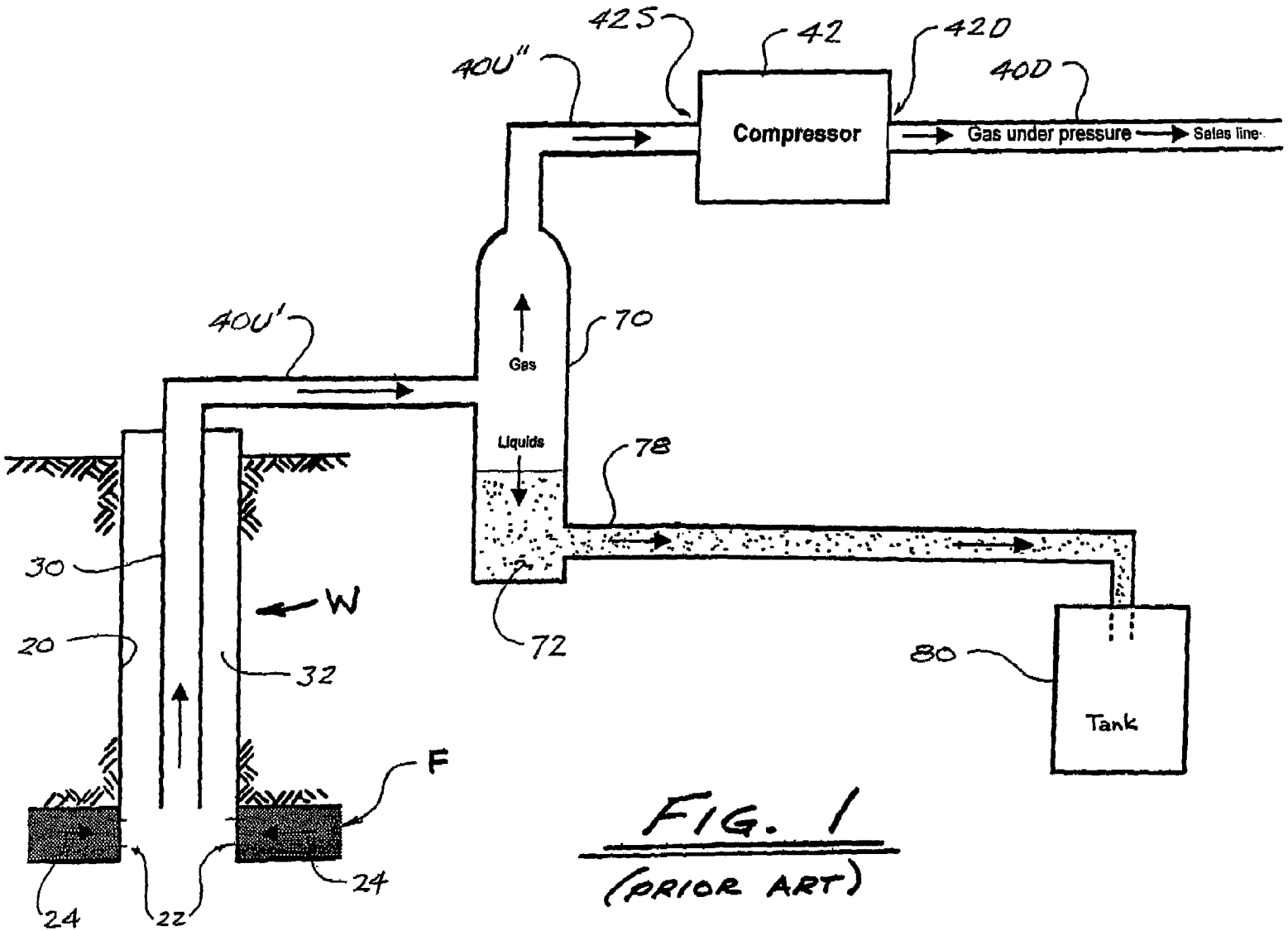
FIG. 1 (PRIOR ART)
FIG. 1 is a schematic diagram of a well producing natural gas in accordance with prior art methods and apparatus.

The present invention will be best understood after first reviewing conventional methods and apparatus for carrying natural gas from a well to a compressor. FIG. 1 schematically illustrates a typical natural gas well W configured in accordance with prior art methods and apparatus. The well W penetrates a subsurface formation F containing natural gas (typically along with water and crude oil in some proportions). The well W is lined with a casing 20 which has a number of perforations conceptually illustrated by short lines 22 within a production zone (generally corresponding to the portion of the well penetrating the formation F). As conceptually indicated by arrows 24, formation fluids including gas, oil, and water may flow into the well through the perforations 22. A string of tubing 30 extends inside the casing 20, terminating at a point within the production zone. The bottom end of the tubing 30 is open such that fluids in the wellbore may freely enter the tubing 30. An annulus 32 is formed between the tubing 30 and the casing 20. The upper end of the tubing 30 runs into a surface termination apparatus or "wellhead" (not illustrated), of which various types are known in the field of gas wells.

It should be noted that, to facilitate illustration and understanding of the invention, the Figures are not drawn to scale. The diameter of the casing 20 is commonly in the range of 4.5 to 7 inches (114 to 178 mm), and the diameter of the tubing 30 is commonly in the range of 2.375 to 3.5 inches (60 to 89 mm), while the well W typically penetrates hundreds or thousands of feet into the ground. It should also be noted that except where indicated otherwise, the arrows in the Figures denote the direction of flow within various components of the apparatus.

In the well configuration shown in FIG. 1, the tubing 30 serves as the production chamber to carry gas from the well W, under positive pressure, via the wellhead (not shown) to a production pipeline 40 having an upstream section 40U which carries the gas through a gas-liquid separator 70 to the suction manifold 42S of a gas compressor 42. The separator 70 divides the upstream pipeline into section 40U' on the wellhead side of the separator, and section 40U" on the compressor side of the separator 70. The production pipeline 40 also has a downstream section 40D which connects at one end to the discharge manifold 42D of the compressor 42 and continues therefrom to a gas processing facility (not shown). As schematically indicated, liquids 72 separated from the gas flowing in the intake pipeline 40U' will accumulate in a lower section of the separator 70. In the usual case, the liquids 72 flow from the separator 70 to a storage tank 80 on the well site.

Figure 2:
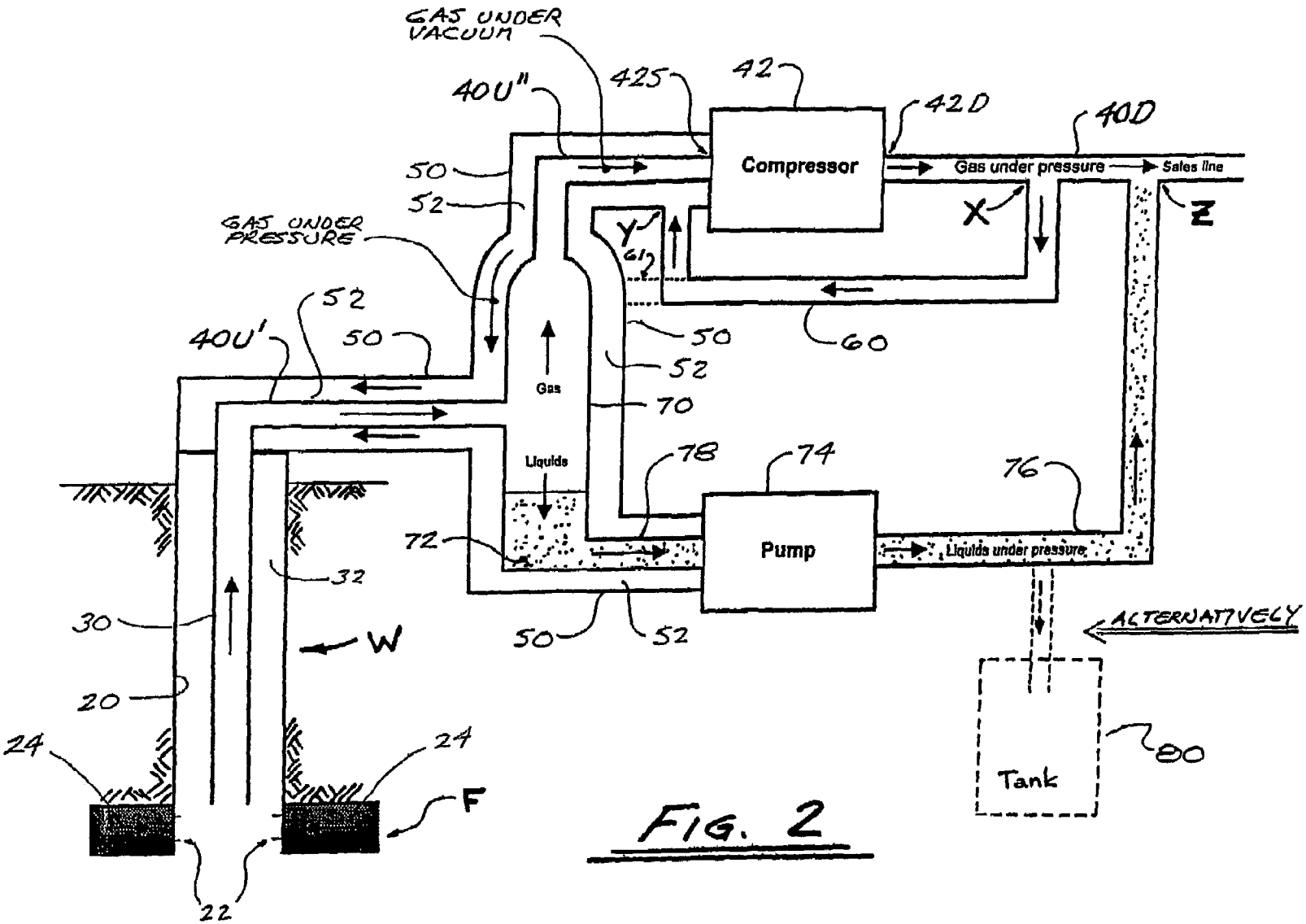
FIG. 2 is a schematic diagram of a well producing natural gas in accordance with a preferred embodiment of the method and apparatus of the present invention.

The present invention may be best understood from reference to FIG. 2. The invention provides for production of gas under negative pressure, in which case the liquids 72 removed from the gas stream by the separator 70 will also be under negative pressure, and for this reason a vacuum pump 74 is provided as shown. The liquids 72 flow under negative pressure through a pump inlet line 78 to the pump 74, which pumps the liquids 72, now under positive pressure, through a liquid return line 76 into the downstream section 40D of production pipeline 40 at a point Z downstream of the compressor 42. Alternatively, the liquids 72 may be pumped to an on-site storage tank 80.

As illustrated in FIG. 2, the upstream pipeline sections 40U' and 40U", the separator 70, and the pump inlet line 78 are fully enclosed by a vapour-tight positive pressure jacket 50 that defines a continuous internal chamber 52. The positive pressure jacket 50 will typically be constructed of welded steel. However, suitable and well-known alternative materials may be used without departing from the fundamental concept and scope of the present invention.

A gas recirculation pipeline 60 extends between, and is in fluid communication with, the downstream section 40D of production pipeline 40 (at point X located between the compressor 42 and point Z) and a selected pressure connection point Y on the positive pressure jacket 50. As shown in FIG. 2, pressure connection point Y may be located in upstream pipeline section 40U" between the compressor 42 and the separator 70. However, this is not essential; pressure connection point Y may be at any convenient location on the positive pressure jacket 50—such as, for example, on the portion of the positive pressure jacket 50 surrounding the separator 70, as schematically indicated by broken lines (marked 61), which depict an optional alternative routing of the recirculation pipeline 60.

By means of the recirculation pipeline 60, a portion of the gas discharged from the discharge manifold 42D of the compressor 42 may be diverted into the positive pressure jacket 50, such that the upstream pipeline sections 40U' and 40U", the separator 70, and the pump inlet line 78 are entirely enclosed by a "blanket" of gas under positive pressure.

The positive pressure jacket 50 thus enshrouds all components of the apparatus containing combustible fluids under negative pressure between the wellhead and the suction manifold 42S of compressor 42 with a blanket of gas under positive pressure, thereby preventing the entry of air into the combustible fluids present in any of those components.

In the preferred embodiment, the positive pressure jacket 50 also encloses any portions of the wellhead containing gas under negative pressure.

The embodiment shown in FIG. 2 provides for what may be termed a "static" positive pressure blanket, as the gas inside the positive pressure jacket 50 will be essentially stationary. In an alternative embodiment of the invention, illustrated in FIG. 3, the internal chamber 52 of the positive pressure jacket 50 is in fluid communication with the annulus 32 of the well W, such that gas from the internal chamber 52 of the positive pressure jacket 50 can be injected into the annulus 32. As shown schematically in FIG. 3, a pressure regulator valve 54 is provided to regulate the gas pressure inside the positive pressure jacket 50. The pressure regulator valve 54 may be set such that it will open, thus allowing gas to enter the annulus 32, only when the gas pressure in the internal chamber 52 of the positive pressure jacket 50 is above a selected value. Under either static conditions (as in FIG. 2) or gas injection conditions (as in FIG. 3), internal chamber pressures in the approximate range of 40 to 50 pounds per square inch (275 to 345 kPa) are considered desirable. However, higher or lower pressures may be used without departing from the concept and principles of the present invention.

Figure 3:
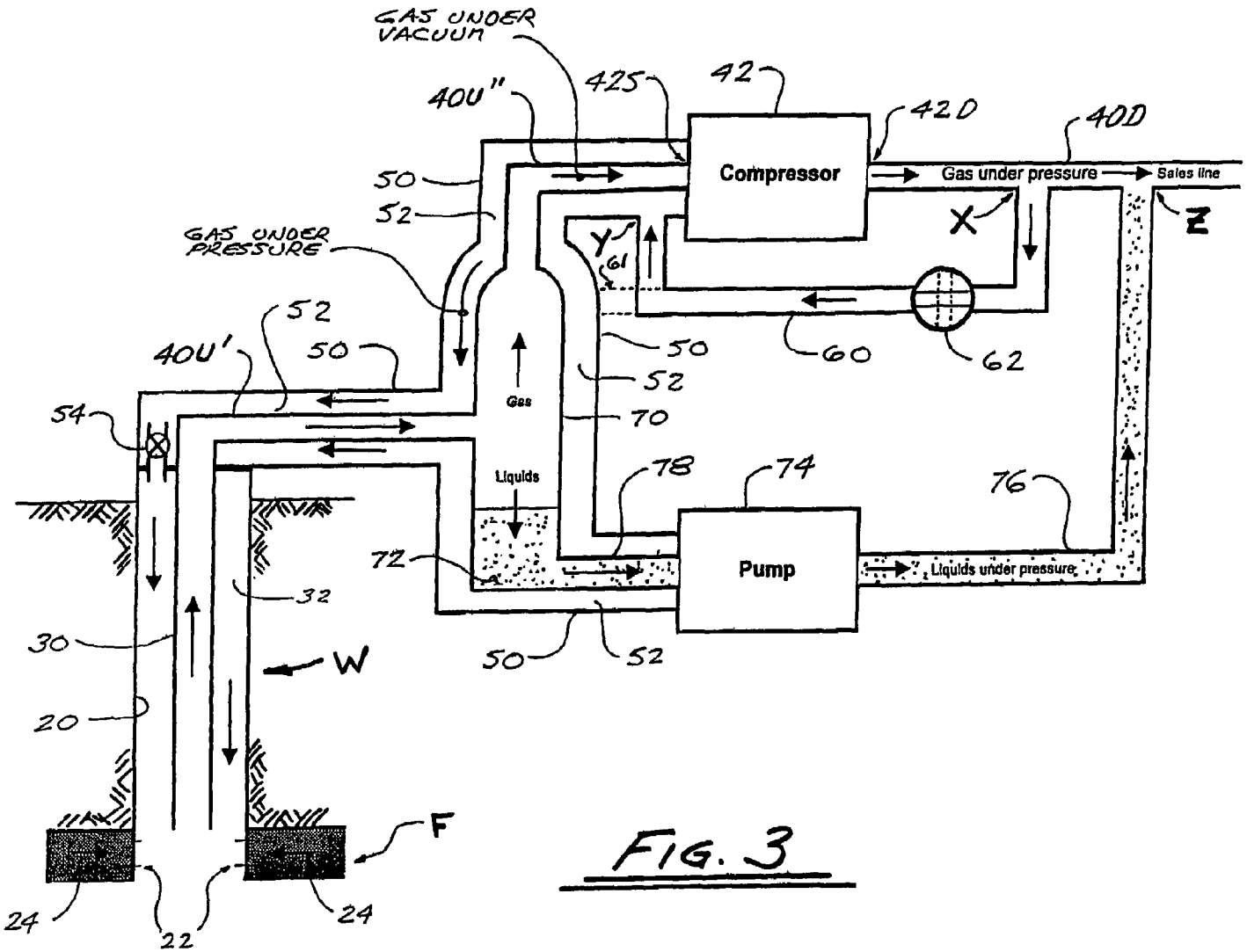
FIG. 3 is a schematic diagram of a well producing natural gas in accordance with an alternative embodiment of the method and apparatus of the invention.

As schematically illustrated in FIG. 3, a throttling valve (or "choke") 62 optionally may be provided in association with the recirculation pipeline 60, to regulate the flow of gas from the downstream section 40D of production pipeline 40 into the recirculation pipeline 60 and thence into the internal chamber 52 of the positive pressure jacket 50 and ultimately into the well W.

Figure 4:
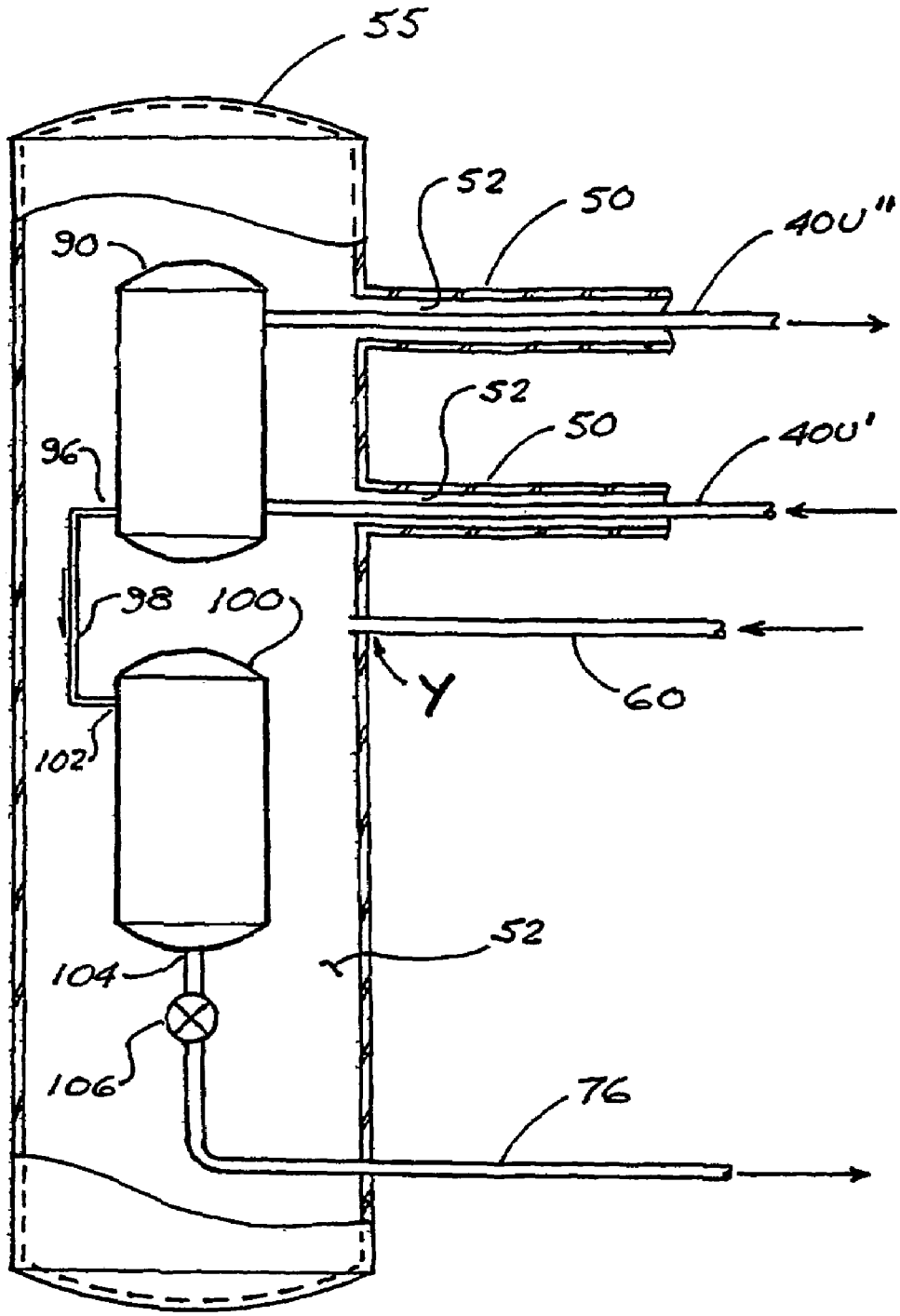
FIG. 4 is a partial cutaway schematic diagram of a separator having a positive pressure gas jacket in accordance with a preferred embodiment of the invention.

FIG. 4 schematically illustrates a preferred construction of the separator 70 and the corresponding section of the positive pressure jacket 50 in accordance with the present invention. In this embodiment, the separator 70 comprises two main components, a vertical separator 90 and a blow case 100, the construction and operation of which are in accordance with well known technology. Upstream pipeline section 40U' delivers raw well gas under negative pressure to the separator. Upstream pipeline section 40U" delivers dry gas from the separator 70 to the suction manifold 42S of the compressor 42. The vertical separator 90 and blow case 100 are enclosed within a separator jacket 55 forming part of the overall positive pressure jacket 50. Injection pipeline 60, carrying gas under pressure from the downstream pipeline 40D, is connected to the positive pressure jacket 50 at pressure connection point Y (which in the embodiment shown in FIG. 4 is located on separator jacket 55, but may be located elsewhere on the positive pressure jacket 50 as previously mentioned). Regardless of the location of pressure connection point Y, gas under pressure is introduced into the internal chamber 52 of the positive pressure jacket 50, such that all system components carrying raw gas from the well W under negative pressure will be surrounded by gas under positive pressure.

Liquids 72 removed from the gas are discharged from the vertical separator 90 at liquid outlet 96 through liquid transfer line 98, which in turn carries the liquids 72 to the blow case 100 through blow case inlet port 102. The blow case 100 accumulates separated liquids under positive pressure. Liquid return line 76 connects to the blow case 100 at blow case discharge port 104. A check valve 106 prevents liquids from being discharged from the blow case 100 unless the pressure in the blow case exceeds a pre-set value. In this embodiment, there is no need for a pump 74 (as in the embodiments shown in FIG. 2 and FIG. 3) and therefore no pump inlet line 78. The flow in the liquid return line 76 will always be under positive pressure as it exits the separator jacket 55.

Alternative methods of constructing the positive pressure jacket 50 around the separator 70, using known fabrication methods and materials, will be readily apparent to persons skilled in the art, without departing from the principles of the invention.

The method and apparatus of the present invention can be particularly advantageous when used in conjunction with gas wells in which gas injection is used to enhance recovery of gas from the formation F. Gas injection provides this benefit by further reducing bottomhole pressures in the well W. Formation pressures in virgin gas reservoirs tend to be relatively high. Therefore, upon initial completion of a well, the gas will commonly rise naturally to the surface provided that the characteristics of the reservoir and the wellbore are suitable to produce stable flow (meaning that the gas velocity at all locations in the production chamber remains equal to or greater than the critical velocity—in other words, velocity-induced flow).

However, as wells penetrate the reservoir and gas reserves are depleted, the formation pressure drops continuously, inevitably to a level too low to induce gas velocities high enough to sustain stable flow. Therefore, all flowing gas wells producing from reservoirs with depleting formation pressure eventually become unstable. Once the gas velocity has become too low to lift liquids, the liquids accumulate in the wellbore, and the well is said to be "liquid loaded". This accumulation of liquids results in increased bottomhole flowing pressures and reduced gas recoveries. Injection of recirculated gas can effectively prevent or alleviate liquid loading, by increasing the upward velocity of the gas stream in the production chamber so as to maintain a gas velocity at or above the critical velocity for the well in question, thus maintaining velocity-induced flow. Methods and apparatus for gas injection for this purpose are described in the present Applicant's Canadian Patent Application No. 2,424,745, filed on Apr. 9, 2003 and corresponding International Application No. PCT/CA2004/000478, filed on Mar. 30, 2004.

Figure 5:
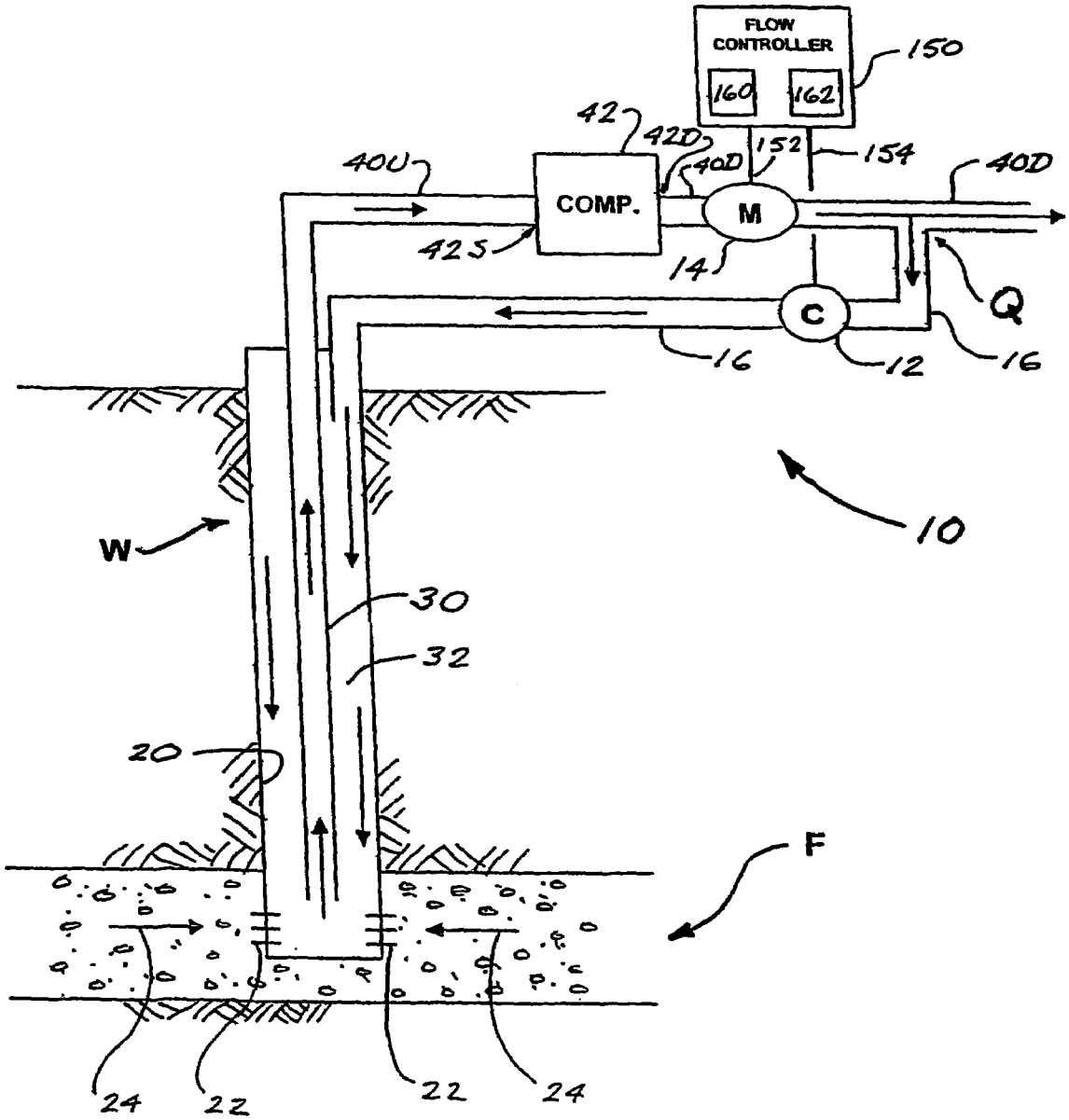
FIG. 5 is a schematic diagram of a gas well producing natural gas using a prior art gas injection system.

FIG. 5 illustrates a gas well producing natural gas using an embodiment of the gas injection system disclosed in PCT/CA2004/000478. In the well configuration shown in FIG. 5, the tubing 30 serves as the production chamber to carry gas from the well W to an above-ground production pipeline 40, which has an upstream section 40U and a downstream section 40D. The tubing 30 connects in fluid communication with one end of the upstream section 40U (via wellhead apparatus, not shown), and the other end of the upstream section 40U is connected to the suction manifold 42S of a gas compressor 42. The downstream section 40D of the production pipeline 40 connects at one end to the discharge manifold 42D of the compressor 42 and continues therefrom to a gas processing facility (not shown). A gas injection pipeline 16, for diverting production gas from the production pipeline 40 for injection into the injection chamber (i.e., the annulus 32, in FIG. 5), is connected at one end to the downstream section 40D of the production pipeline 40 at a point Q, and at its other end to the top of the injection chamber. Also provided is a throttling valve (or "choke") 12, which is operable to regulate the flow of gas from the production pipeline 40 into the injection pipeline 16 and the injection chamber.

The choke 12 may be of any suitable type. In a fairly simple embodiment of the apparatus, the choke 12 may be of a manually-actuated type, which may be manually adjusted to achieve desired rates of gas injection, using trial-and-error methods as may be necessary or appropriate; with practice, a skilled well operator can develop a sufficiently practical ability to determine how the choke 12 needs to be adjusted to achieve stable gas flow in the production chamber, without actually quantifying the necessary minimum gas injection rate or the flow rate in the production chamber. Alternatively, the choke 12 may be an automatic choke; e.g., a Kimray® Model 2200 flow control valve.

In the preferred embodiment, however, a flow controller 150 is provided for operating the choke 12. Also provided is a flow meter 14 adapted to measure the rate of total gas flow up the production chamber, and to communicate that information to the flow controller 50. The flow controller 150 may be a pneumatic controller of any suitable type; e.g., a Fisher™ Model 4194 differential pressure controller.

To implement the gas injection system illustrated in FIG. 5, a critical gas flow rate is determined. The critical flow rate, which may be expressed in terms of either gas velocity or volumetric flow, is a parameter corresponding to the minimum velocity $V_{cr}$ that must be maintained by a gas stream flowing up the production chamber (i.e., the tubing 30, in FIG. 5) in order to carry formation liquids upward with the gas stream (i.e., by velocity-induced flow). This parameter is determined in accordance with well-established methods and formulae taking into account a variety of quantifiable factors relating to the well construction and the characteristics of formation from which the well is producing. A minimum total flow rate (or "set point") is then selected, based on the calculated critical flow rate, and flow controller 150 is set accordingly. The selected set point will preferably be somewhat higher than the calculated critical rate, in order to provide a reasonable margin of safety, but also preferably not significantly higher than the critical rate, in order to minimize friction loading in the production chamber.

If the total flow rate measured by the meter 14 is less than the set point, the flow controller 150 will adjust the choke 12 to increase the gas injection rate if and as necessary to increase the total flow rate to a level at or above the set point. If the total flow rate is at or above the set point, there may be no need to adjust the choke 12. The flow controller 50 may be adapted such that if the total gas flow is considerably higher than the set point, the flow controller 150 will adjust the choke 12 to reduce the gas injection rate, thus minimizing the amount of gas being recirculated to the well through injection, and maximizing the amount of gas available for processing and sale.

In one particular embodiment of the gas injection system, the flow controller 150 has a computer with a microprocessor (conceptually illustrated by reference numeral 160) and a memory (conceptually illustrated by reference numeral 162). The flow controller 150 also has a meter communication link (conceptually illustrated by reference numeral 152) for receiving gas flow measurement data from the meter 14. The meter communication link 152 may comprise a wired or wireless electronic link, and may comprise a transducer. The flow controller 150 also has a choke control link (conceptually illustrated by reference numeral 154), for communicating a control signal from the computer 160 to a choke control means (not shown) which actuates the choke 12 in accordance with the control signal from the computer. The choke control link 154 may comprise a mechanical linkage, and may comprise a wired or wireless electronic link.

Using this embodiment of the apparatus, the set point is stored in the memory 162. The computer 160 receives a signal from the meter 14 (via the meter communication link 152) corresponding to the measured total gas flow rate in the production chamber, and, using software programmed into the computer 160, compares this value against the set point. The computer 160 then calculates a minimum injection rate at which supplementary is gas must be injected into the injection chamber, or to which the injection rate must be increased in order to keep the total flow rate at or above the set point. This calculation takes into account the current gas injection rate (which would be zero if no gas is being injected at the time). If the measured total gas flow is below the set point, the computer 160 will convey a control signal, via the choke control link 154, to the choke control means, which in turn will adjust the choke 12 to deliver injection gas, at the calculated minimum injection rate, into the injection pipeline 16, and thence into the injection chamber of the well (i.e., the annulus 32, in FIG. 1). If the measured total gas flow equals or exceeds the set point, no adjustment of the choke 12 will be necessary, strictly speaking.

However, the computer 160 may also be programmed to reduce the injection rate if it is substantially higher than the set point, in order to minimize the amount of gas being recirculated to the well W, thus maximizing the amount of gas available for processing and sale, as well as to minimize friction loading. In fact, situations may occur in which there effectively is a "negative" gas injection rate; i.e., where rather than having gas being injected downward into the well through a selected injection chamber, gas is actually flowing to the surface through both the tubing 30 and the annulus 32. This situation could occur when formation pressures are so great that the upward gas velocity in the selected production chamber is not only high enough to maintain a velocity-induced flow regime, but also so high that excessive friction loading develops in the production chamber. In this scenario, gas production would be optimized by producing gas up both chambers, thus reducing gas velocities and resultant friction loading (provided of course that the gas velocity—which will be naturally lower than when producing through only one chamber—remains above $V_{cr}$ at all points in at least one of the chambers; i.e., so that there is stable flow in at least one chamber).

Figure 6:
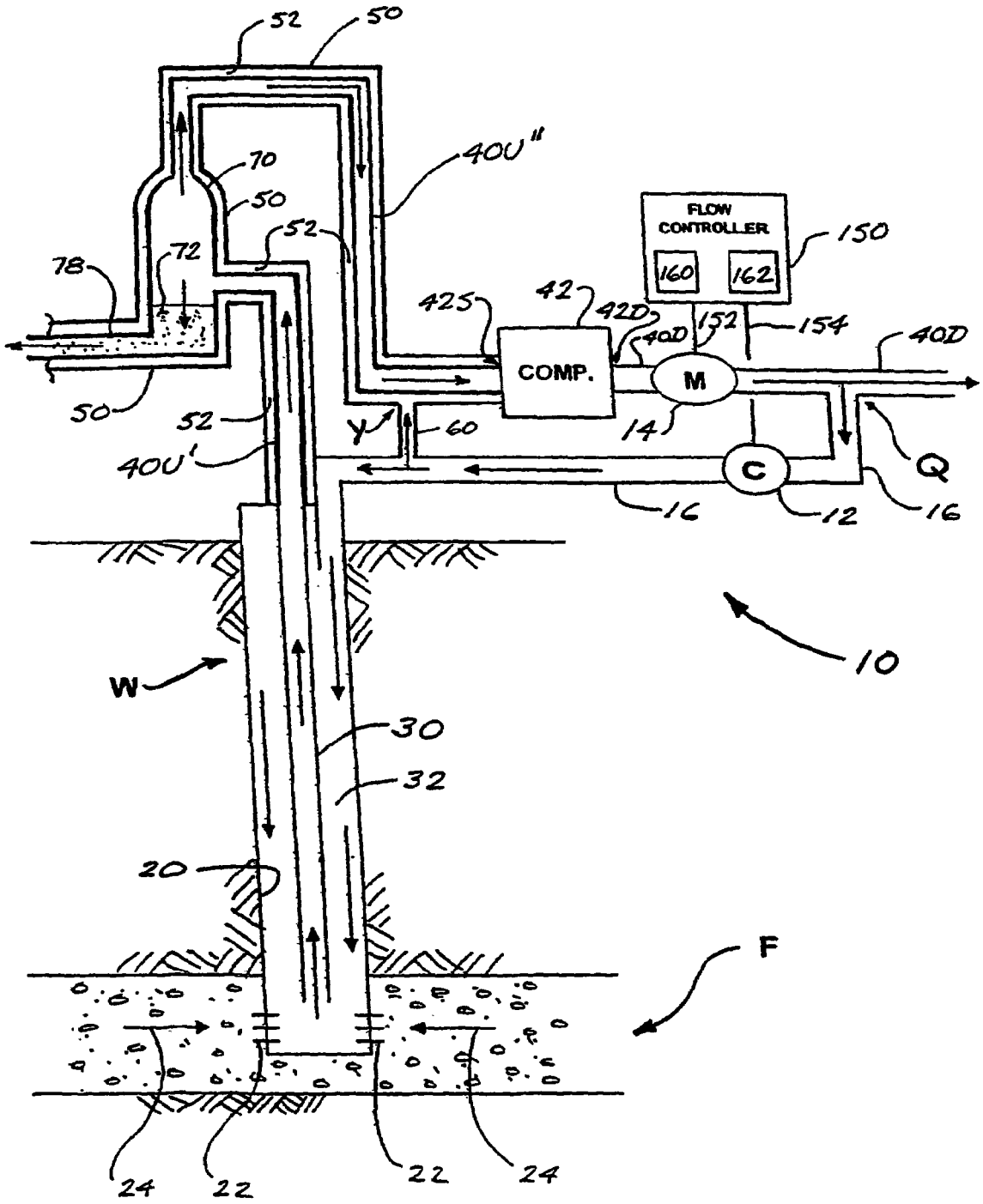
FIG. 6 is a schematic diagram of the gas well shown in FIG. 5, producing natural gas using a prior art gas injection system, modified to incorporate the positive pressure jacket of the present invention.

FIG. 6 illustrates the well and gas injection system shown in FIG. 5, but modified to incorporate the positive pressure jacket of the present invention, with separator and positive pressure jacket components corresponding to those described and illustrated in connection with FIG. 2 and FIG. 5. In the embodiment shown in FIG. 6, the recirculation pipeline 60 ties in to the injection pipeline 16, but this is only a representative illustration of one means of providing gas under positive pressure to the internal chamber 52 of the positive pressure jacket 50. For example, the recirculation pipeline 60 could be a separate line connecting to downstream pipeline 40D, independent of injection pipeline 16.

Although not illustrated, it will be appreciated that the gas injection embodiments shown in FIGS. 3, 4, and 6 can be readily adapted for use in association with a gas well in which the annulus 32 serves as the production chamber. In that case, the upstream section 40U of intake pipeline 40 will be in fluid communication with the annulus 32, and the internal chamber 52 of the positive pressure jacket 50 will be in fluid communication with the production tubing 30. Accordingly, pressurized gas diverted into the internal chamber 52 will be injected into the well W through the tubing 30, with the same production-enhancing benefits as described previously in connection with embodiments wherein the tubing 30 serves as the production chamber.

It will be readily appreciated by those skilled in the art that various modifications of the present invention may be devised without departing from the essential concept of the invention, and all such modifications are intended to be included in the scope of the claims appended hereto.

In this patent document, the word "comprising" is used in its non-limiting sense to mean that items following that word are included, but items not specifically mentioned are not excluded. A reference to an element by the indefinite article "a" does not exclude the possibility that more than one of the element is present, unless the context clearly requires that there be one and only one such element.

The invention claimed is:

1. A positive pressure gas jacket apparatus for use in association with a natural gas well facility, said well facility comprising:

(a) a wellbore extending from ground surface into a subsurface gas production zone;

(b) a wellhead apparatus at the top of the wellbore;

(c) a tubing string extending from the wellhead into the wellbore, for conveying gas from the production zone, said tubing string and wellbore defining an annulus;

(d) an upstream pipeline in fluid communication with a production chamber selected from the tubing and the annulus, and connecting to the suction manifold of a gas compressor; and (e) a downstream pipeline extending from the discharge manifold of the compressor;

said apparatus comprising:

(f) a vapour-tight enclosure defining an internal chamber surrounding the upstream pipeline; and (g) a gas recirculation pipeline extending between a selected point on the downstream pipeline and a selected point on the vapour-tight enclosure, such that the gas recirculation pipeline is in fluid communication with both the downstream pipeline and the internal chamber of the vapour-tight enclosure;

characterized in that the upstream pipeline will be completely enveloped by pressurized natural gas introduced into the internal chamber from the downstream pipeline via the recirculation pipeline.

2. The positive pressure gas jacket apparatus of claim 1 wherein the internal chamber of the vapour-tight enclosure surrounds portions of the wellhead apparatus conveying natural gas under negative pressure between the tubing and the upstream pipeline.

3. The positive pressure gas jacket apparatus of claim 1, further comprising a throttling valve in the recirculation pipeline, for regulating the flow of gas from the downstream pipeline into the recirculation pipeline.

4. The positive pressure gas jacket apparatus of claim 1, further comprising a pressure regulator valve disposed between:

(a) the internal chamber of the vapour-tight enclosure; and (b) a well injection chamber selected from the tubing and the annulus, said injection chamber not being the production chamber;

said valve being for preventing gas pressure in the internal chamber from exceeding a selected pre-set value, by allowing gas from the internal chamber to enter the well injection chamber when the internal chamber pressure exceeds the pre-set value.

5. The positive pressure gas jacket apparatus of claim 1 wherein the vapour-tight enclosure is of welded steel construction.

6. The positive pressure gas jacket apparatus of claim 1, further comprising a gas-liquid separator apparatus connected into the upstream pipeline for separating liquids out of raw gas from the well, said separator apparatus having a liquid discharge line for removing separated liquids, and wherein the internal chamber of the vapour-tight enclosure surrounds the separator apparatus as well as the upstream pipeline, such that pressurized gas introduced into the internal chamber from the downstream pipeline via the recirculation pipeline will completely envelope both the separator apparatus and the discharge line.

7. The positive pressure gas jacket apparatus of claim 6 wherein:

(a) the separator apparatus comprises a separator vessel, a blow case, and a liquid transfer line for carrying separated liquids from the separator vessel to the blow case, said blow case being a pressure vessel for accumulating the separated liquids and discharging said liquids under positive pressure; and (b) the liquid discharge line connects to the blow case and extends therefrom through the vapour-tight enclosure for conveying liquids from the blow case under positive pressure to a liquid disposal point.

8. The positive pressure gas jacket apparatus of claim 7 wherein the liquid discharge line conveys liquids to a storage tank.

9. The positive pressure gas jacket apparatus of claim 7 wherein the liquid discharge line conveys liquids to the downstream pipeline at a point downstream of the connection between the recirculation pipeline and the downstream pipeline.

10. The positive pressure gas jacket apparatus of claim 6 wherein liquids removed by the separator apparatus are discharged into the liquid discharge line under negative pressure, and wherein:

(a) the liquid discharge line connects to a vacuum pump;

(b) the vacuum pump discharges liquids under positive pressure into a liquid return line; and (c) the internal chamber of the vapour-tight enclosure surrounds the liquid discharge line as well as the separator apparatus and the upstream pipeline, such that pressurized gas introduced into the internal chamber from the downstream pipeline via the recirculation pipeline will completely envelope the upstream pipeline, the separator apparatus, and the liquid discharge line.

11. The positive pressure gas jacket apparatus of claim 1 wherein the well facility further comprises:

(a) a gas injection pipeline having a first end connected to and in fluid communication with the downstream pipeline at a point downstream of the compressor, and a second end connected in fluid communication with an injection chamber selected from the tubing and the annulus, said injection chamber not being the production chamber; and (b) a choke, for regulating the flow of gas in the injection pipeline.

12. The apparatus of claim 11, further comprising a flow meter for measuring gas flow in the production chamber.

13. The apparatus of claim 12, further comprising a flow controller associated with the flow meter, said flow controller having means for operating the choke.

14. The apparatus of claim 13 wherein the flow controller is a pneumatically-actuated flow controller.

15. The apparatus of claim 13 wherein the flow controller comprises a computer with a memory, and wherein:

(a) the flow controller is adapted to receive gas flow data from the flow meter, corresponding to total gas flow rates in the production chamber;

(b) the memory is adapted to store a minimum total flow rate;

(c) the computer is programmed to:

c.1 compare a total gas flow rate measured by the meter against the minimum total flow rate; and c.2 determine a minimum gas injection rate necessary to maintain the total gas flow rate in the production chamber at or above the minimum total flow rate; and (d) the flow controller is adapted to automatically set the choke to permit gas flow into the injection chamber at a rate not less than the minimum gas injection rate.

16. The apparatus of claim 12 wherein the meter is installed in the production pipeline at a point downstream of the compressor.

17. The apparatus of claim 12 wherein the meter is installed in the production pipeline at a point upstream of the compressor.

18. The apparatus of claim 11 wherein the production chamber is the tubing, and the injection chamber is the annulus.

19. The apparatus of claim 11 wherein the production chamber is the annulus, and the injection chamber is the tubing.

20. The apparatus of claim 11, further comprising a back-pressure valve in the production pipeline at a point downstream of the intersection between the gas injection pipeline and the downstream pipeline.

21. For use in association with a natural gas well facility, said well facility comprising:

(a) a wellbore extending from ground surface into a subsurface gas production zone;

(b) a wellhead apparatus at the top of the wellbore;

(c) a tubing string extending from the wellhead into the wellbore, for conveying gas from the production zone, said tubing string and wellbore defining an annulus;

(d) an upstream pipeline in fluid communication with a production chamber selected from the tubing and the annulus, and connecting to the suction manifold of a gas compressor; and (e) a downstream pipeline extending from the discharge manifold of the compressor;

a method of preventing air leaks into the upstream pipeline when conveying natural gas under negative pressure from the production chamber to the compressor, said method comprising the steps of:

(f) providing a vapour-tight enclosure defining an internal chamber surrounding the upstream pipeline; and (g) providing a gas recirculation pipeline extending between a selected point on the downstream pipeline and a selected point on the vapour-tight enclosure, such that the gas recirculation pipeline is in fluid communication with both the downstream pipeline and the internal chamber of the vapour-tight enclosure;

said method being characterized in that the upstream pipeline will be completely enveloped by pressurized natural gas introduced into the internal chamber from the downstream pipeline via the recirculation pipeline.

22. The method of claim 21 wherein the internal chamber of the vapour-tight enclosure surrounds portions of the wellhead apparatus conveying natural gas under negative pressure between the tubing and the upstream pipeline.

23. The method of claim 21, further comprising a throttling valve in the recirculation pipeline, for regulating the flow of gas from the downstream pipeline into the recirculation pipeline.

24. The method of claim 21, further comprising a pressure regulator valve disposed between:

(a) the internal chamber of the vapour-tight enclosure; and (b) a well injection chamber selected from the tubing and the annulus, said injection chamber not being the production chamber;

said valve being for preventing gas pressure in the internal chamber from exceeding a selected pre-set value, by allowing gas from the internal chamber to enter the well injection chamber when the internal chamber pressure exceeds the pre-set value.

25. The method of claim 21 wherein the vapour-tight enclosure is of welded steel construction.

26. The method of claim 21, further comprising a gas-liquid separator apparatus connected into the upstream pipeline for separating liquids out of raw gas from the well, said separator apparatus having a liquid discharge line for removing separated liquids, and wherein the internal chamber of the vapour-tight enclosure surrounds the separator apparatus as well as the upstream pipeline, such that pressurized gas introduced into the internal chamber from the downstream pipeline via the recirculation pipeline will completely envelope both the separator apparatus and the discharge line.

27. The method of claim 26 wherein:

(a) the separator apparatus comprises a separator vessel, a blow case, and a liquid transfer line for carrying separated liquids from the separator vessel to the blow case, said blow case being a pressure vessel for accumulating the separated liquids and discharging said liquids under positive pressure; and (b) the liquid discharge line connects to the blow case and extends therefrom through the vapour-tight enclosure for conveying liquids from the blow case under positive pressure to a liquid disposal point.

28. The method of claim 27 wherein the liquid discharge line conveys liquids to a storage tank.

29. The method of claim 27 wherein the liquid discharge line conveys liquids to the downstream pipeline at a point downstream of the connection between the recirculation pipeline and the downstream pipeline.

30. The method of claim 26 wherein liquids removed by the separator apparatus are discharged into the liquid discharge line under negative pressure, and wherein:

(a) the liquid discharge line connects to a vacuum pump;

(b) the vacuum pump discharges liquids into a under positive pressure into a liquid return line; and (c) the internal chamber of the vapour-tight enclosure surrounds the liquid discharge line as well as the separator apparatus and the upstream pipeline, such that pressurized gas introduced into the internal chamber from the downstream pipeline via the recirculation pipeline will completely envelope the upstream pipeline, the separator apparatus, and the liquid discharge line.

* * * * *